US005785215A

United States Patent [19]

Hinkel

[11] Patent Number: 5,785,215

[45] Date of Patent: Jul. 28, 1998

[54] DRAWSTRING RESTRINGING APPARATUS

[76] Inventor: John Allen Hinkel, P.O. Box 3213, Alpine, Wyo. 83128

[21] Appl. No.: 747,439

[22] Filed: Nov. 12, 1996

[51] Int. Cl.[6] ..... A41H 43/00

[52] U.S. Cl. ..... 223/50; 223/103

[58] Field of Search ..... 223/50, 102, 103, 223/104, 105

[56] References Cited

U.S. PATENT DOCUMENTS

| | | | |
|---|---|---|---|
| 1,119,659 | 12/1914 | Steiner et al. . | |
| 1,943,174 | 1/1934 | Gagnon | 223/102 |
| 2,041,674 | 5/1936 | De Spain | 223/102 |
| 2,581,564 | 1/1952 | Villegas | 223/102 |
| 2,705,098 | 3/1955 | Sipler, Jr. | 223/102 |
| 3,416,713 | 12/1968 | Stephens | 223/104 |
| 3,872,806 | 3/1975 | Bone | 223/104 |
| 4,671,437 | 6/1987 | Sauger . | |
| 4,863,079 | 9/1989 | Holmgren . | |
| 5,353,972 | 10/1994 | Mandel . | |
| 5,447,260 | 9/1995 | Beddow . | |
| 5,524,800 | 6/1996 | Arney | 223/50 |

*Primary Examiner*—Bibhu Mohanty

[57] ABSTRACT

A drawstring restringing apparatus includes a front end, a rear end, and a mid-portion located between the front end and the rear end. The front end and a portion of the mid-portion adjacent to the front end are hollow. A leading portion of the front end is tapered from a top portion of the front end to a bottom portion of the front end. A portion of the front end, which is behind the leading portion, includes a closed top. A portion of the mid-portion adjacent to the front end includes an open top, and the open top defines a mid-portion gap which has a mid-portion-gap width. The open top of the mid-portion extends through the rear end, whereby the rear end also includes an open top. The closed top of the front end includes a slit. The slit has a slit-gap width. The slit-gap width is less than the mid-portion-gap width.

4 Claims, 3 Drawing Sheets

FIG 1
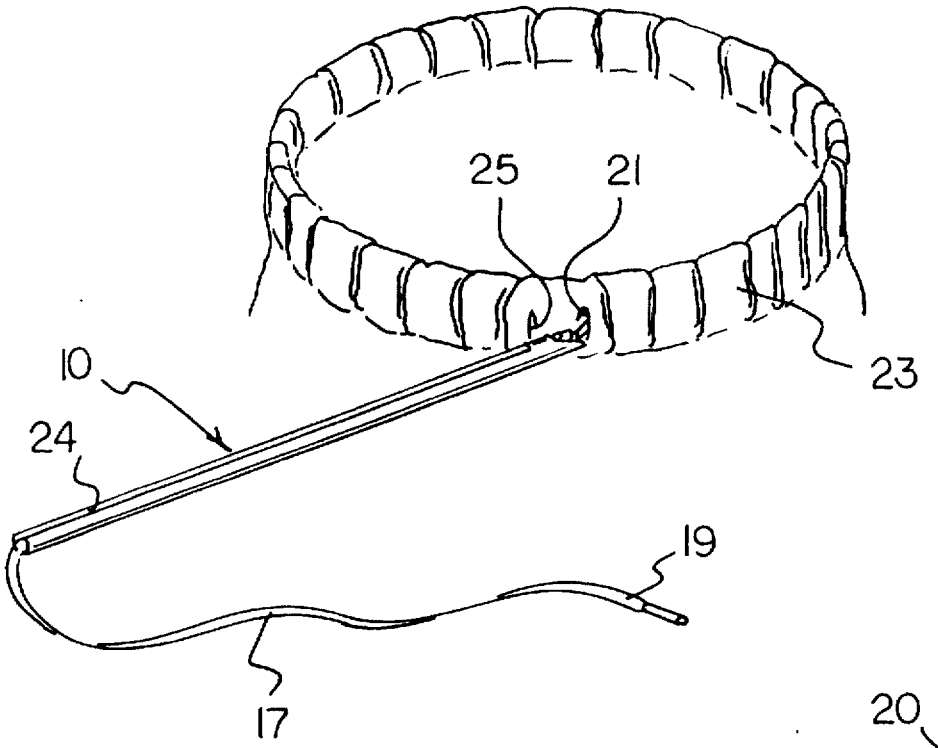
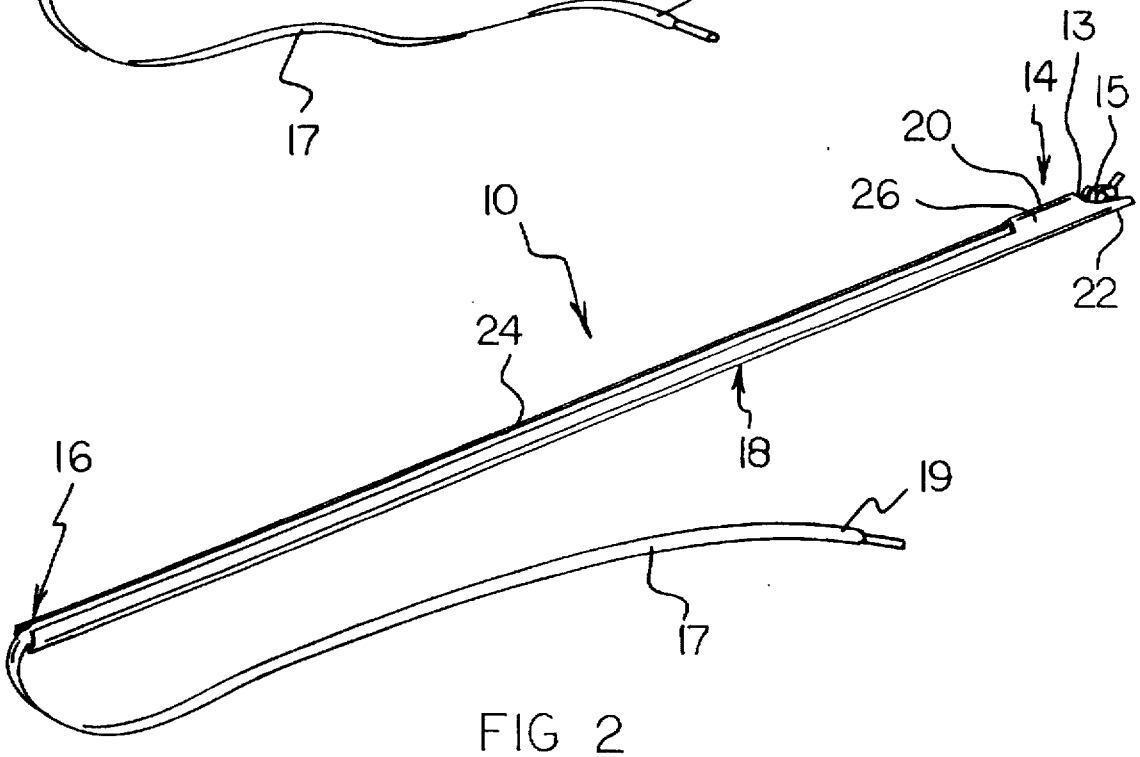
FIG 2

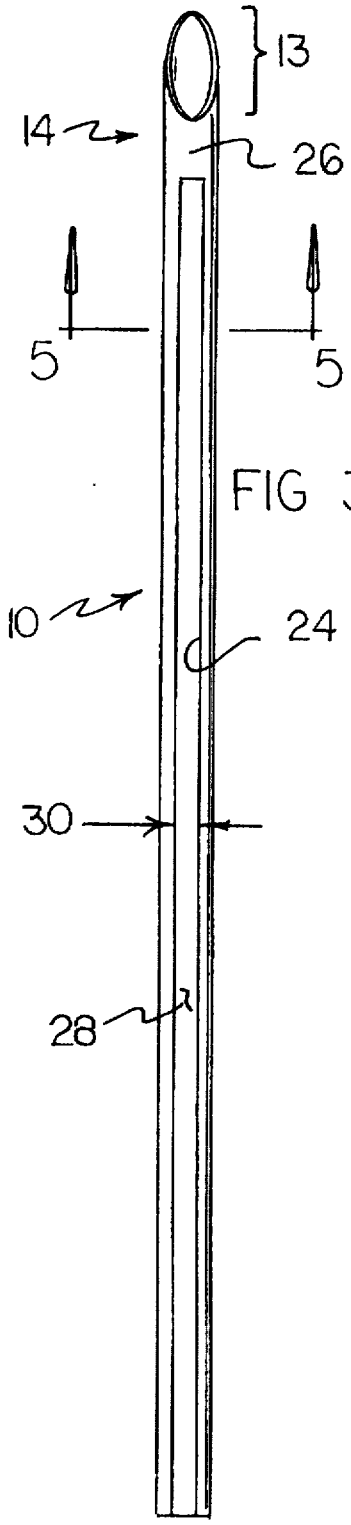
FIG 3
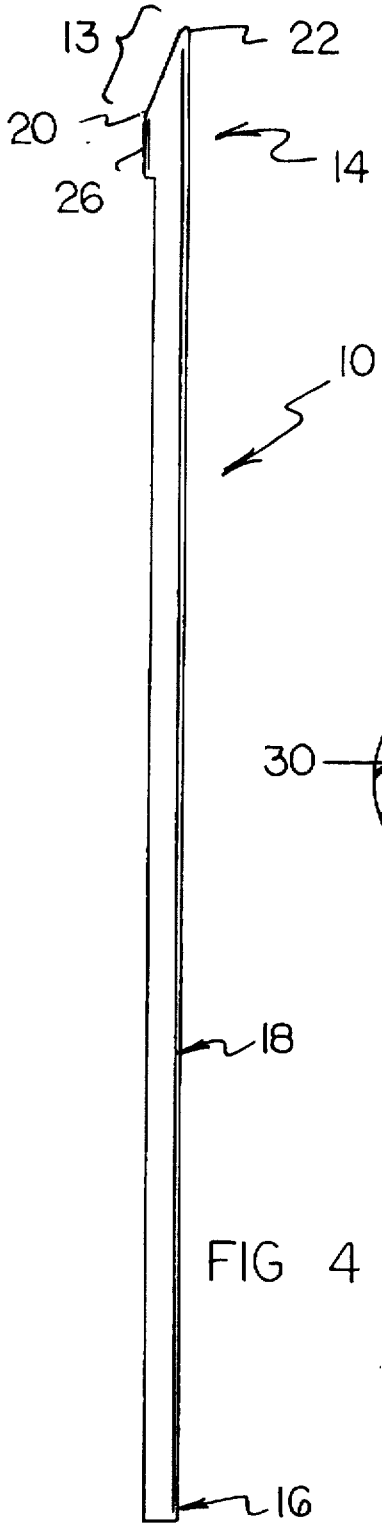
FIG 4
FIG 5
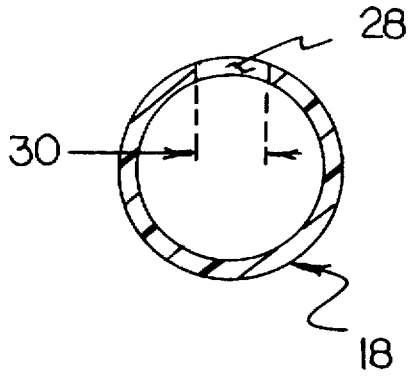

FIG 6
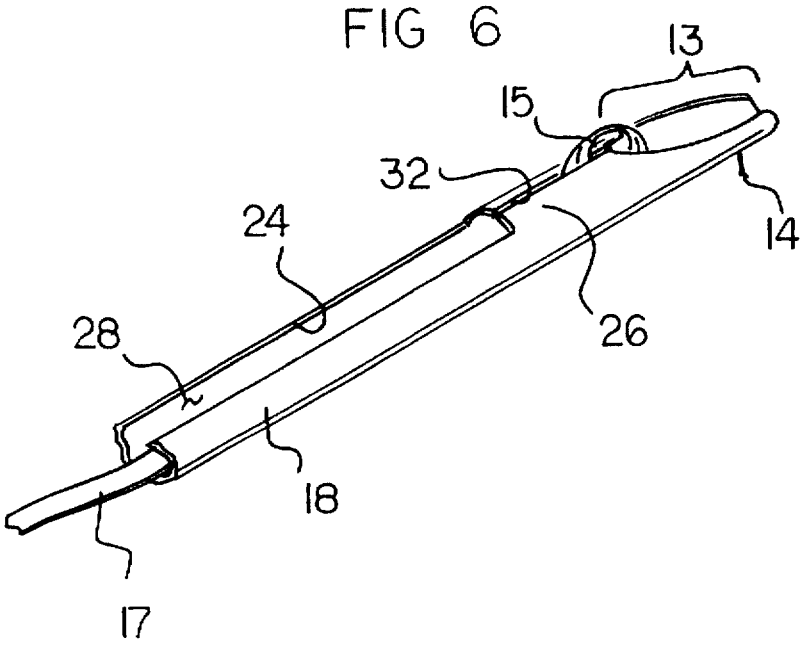
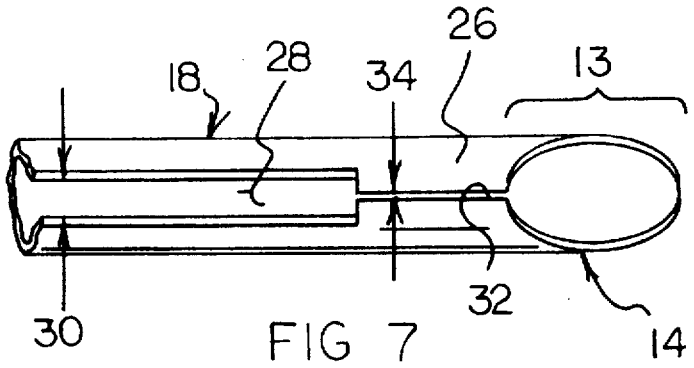
FIG 7

DRAWSTRING RESTRINGING APPARATUS

BACKGROUND OF THE INVENTION

1. Field of the Invention

The present invention relates to devices that are employed for restringing drawstrings in articles which include drawstrings.

2. Description of the Prior Art

A number of articles exist which include drawstrings. Such articles include sweat pants, hooded sweat shirts, and bags, among others. A common occurrence associated with articles which contain drawstrings is the removal of the drawstring from channel in the article which receives the drawstring. Once a drawstring is removed from the drawstring-reception channel in the article, the drawstring must be restrung in the drawstring-reception channel in order for the article to be used in the intended way. In this regard, throughout the years, a number of innovations have been developed relating to drawstring restringing devices, and the following U.S. patents are representative of some of those innovations: U.S. Pat. Nos. 1,119,659, 4,671,437, 4,863,079, 5,353,972, and 5,447,260. More specifically, U.S. Pat. No. 1,119,659 discloses a number of drawstring restringing devices, all of which have a generally C-shaped transverse channel for receiving one end of a drawstring that is to be restrung. One problem that may result from using a C-shaped transverse channel is that the open end portions of the C-shaped channel may snare portions of the wall of the drawstring-reception channel in the article being restrung. If this occurs, the walls of the drawstring-reception channel may be torn. In this respect, it would be desirable if a drawstring restringing device were provided that does not employ a C-shaped transverse portion for receiving a drawstring.

U.S. Pat. No. 4,671,437 discloses a drawstring restringing device which employs a cap that fits over the end of the device to secure the drawstring to the device. With such a device, the cap may unexpectedly fall off of the end of the device when the drawstring restringing is inside the drawstring-reception channel. If this occurs, it may be difficult to recover a loose cap from inside the drawstring-reception channel. In this respect, it would be desirable if a drawstring restringing device were provided which does not employ a cap that is placed on the end of the drawstring restringing device.

U.S. Pat. No. 4,863,079 discloses a drawstring restringing device which employs a helical shaped end for the drawstring-receiving end of the device. The helical end has a relatively wide profile that is much wider than the thickness of the shank of the device. As a result, the helical end may not readily be moved through a relatively narrow drawstring-reception channel that is only slightly larger than the thickness of the shank. In this respect, it would be desirable if a drawstring restringing device were provided which does not employ a helical drawstring-receiving end.

U.S. Pat. No. 5,353,972 discloses a drawstring restringing device which employs a hollow tubular member that has a slot coextensive with the full length of the hollow tubular member. Each end of the hollow tubular member has an edge which is perpendicular to the longitudinal axis of the hollow tubular member. Either end can be used as the end which is inserted into the drawstring-reception channel and which is pushed through a drawstring-reception channel of an article. Because both ends have a perpendicular profile, both ends provide a blunt leading edge for the device as it proceeds through the drawstring-reception channel. Such a blunt leading edge may readily encounter a fold in the wall of the drawstringreception channel and may readily be impeded in its movement through the drawstring-reception channel by such a fold. In this respect, it would be desirable if a drawstring restringing device were provided which does not include a blunt edge which is pushed through a drawstring-reception channel.

U.S. Pat. No. 5,447,260 discloses a drawstring restringing device which includes a pulling member located at the trailing end of the device. A tip of a drawstring is placed in the pulling member, and the drawstring is pulled through the drawstring-reception channel when the main portion of the device is pushed through the drawstring-reception channel. With this device, the pulling force on the tip of the drawstring by the trailing end of the device may be less than the frictional forces of the wall of the drawstring-reception channel on the drawstring. When this occurs, the drawstring will separate from the device. In this respect, it would be desirable if a drawstring restringing device were provided which pushes against a portion of the drawstring as the drawstring is restrung through a drawstring-reception channel.

Thus, while the foregoing body of prior art indicates it to be well known to use drawstring restringing devices, the prior art described above does not teach or suggest a drawstring restringing apparatus which has the following combination of desirable features: (1) does not employ a C-shaped transverse portion for receiving a drawstring; (2) does not employ a cap that is placed on the end of the drawstring restringing device; (3) does not employ a helical drawstring-receiving end; (4) does not include a blunt edge which is pushed through a drawstringreception channel; and (5) has a portion which pushes against a portion of the drawstring as the drawstring is restrung through a drawstring-reception channel. The foregoing desired characteristics are provided by the unique drawstring restringing apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a drawstring restringing apparatus which includes a front end, a rear end, and a mid-portion located between the front end and the rear end. The front end and a portion of the mid-portion adjacent to the front end are hollow. A leading portion of the front end is tapered from a top portion of the front end to a bottom portion of the front end. A portion of the front end, which is behind the leading portion, includes a closed top. A portion of the mid-portion adjacent to the front end includes an open top, and the open top defines a mid-portion gap which has a mid-portion-gap width. The open top of the mid-portion extends through the rear end, whereby the rear end also includes an open top. The closed top of the front end includes a slit. The slit has a slit-gap width. The slit-gap width is less than the mid-portion-gap width.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drawstring restringing apparatus which has all of the advantages of the prior art and none of the disadvantages.

It is another object of the present invention to provide a new and improved drawstring restringing apparatus which may be easily and efficiently manufactured and marketed.

It is a further object of the present invention to provide a new and improved drawstring restringing apparatus which is of durable and reliable construction.

An even further object of the present invention is to provide a new and improved drawstring restringing apparatus which is susceptible of a low cost of manufacture with regard to both materials and labor, and which accordingly is then susceptible of low prices of sale to the consuming public, thereby making such drawstring restringing apparatus available to the buying public.

Still yet a further object of the present invention is to provide a new and improved drawstring restringing apparatus which does not employ a C-shaped transverse portion for receiving a drawstring.

Still another object of the present invention is to provide a new and improved drawstring restringing apparatus that does not employ a cap that is placed on the end of the drawstring restringing device.

Yet another object of the present invention is to provide a new and improved drawstring restringing apparatus which does not employ a helical drawstring-receiving end.

Even another object of the present invention is to provide a new and improved drawstring restringing apparatus that does not include a blunt edge which is pushed through a drawstring-reception channel.

Still a further object of the present invention is to provide a new and improved drawstring restringing apparatus which has a portion which pushes against a portion of the drawstring as the drawstring is restrung through a drawstring-reception channel.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first embodiment of the drawstring restringing apparatus of the invention about to be used with a drawstring for a bag operated by a drawstring.

FIG. 2 is an enlarged perspective view of the embodiment of the drawstring restringing apparatus shown in FIG. 1 removed from the bag and with a drawstring in place in the apparatus.

FIG. 3 is an enlarged top view of the embodiment of the drawstring restringing apparatus of FIG. 2 with the drawstring removed.

FIG. 4 is a side view of the embodiment of the invention shown in FIG. 3.

FIG. 5 is an enlarged cross-sectional view of the embodiment of the invention shown in FIG. 3 taken along line 5—5 thereof.

FIG. 6 is perspective view of a portion of a second embodiment of the drawstring restringing apparatus of the invention with a drawstring in place.

FIG. 7 is a top view of the portion of the embodiment of the invention shown in FIG. 6 with the drawstring removed.

DESCRIPTION OF THE PREFERRED EMBODIMENT

With reference to the drawings, a new and improved drawstring restringing apparatus embodying the principles and concepts of the present invention will be described.

Turning to FIGS. 1–5, there is shown a first embodiment of the drawstring restringing apparatus of the invention generally designated by reference numeral 10. In the first embodiment, drawstring restringing apparatus 10 includes a hollow main body having a front end 14, a rear end 16, and a mid-portion 18 located between the front end 14 and the rear end 16. As shown in the drawings, at least the front end 14 and a portion of the mid-portion 18 adjacent to the front end 14 are hollow. A leading portion 13 of the front end 14 is tapered from a top portion 20 of the front end 14 to a bottom portion 22 of the front end 14. A portion of the front end 14, which is behind the leading portion 13, includes a closed top 26. A portion of the mid-portion 18 adjacent to the front end 14 includes an open top 24, and the open top 24 defines a mid-portion gap 28 which has a mid-portion-gap width 30. The open top 24 of the mid-portion 18 extends through the rear end 16, whereby the rear end 16 also includes an open top.

To use the first embodiment of the invention, as shown in FIG. 1, a knot 15 is tied at one end of a drawstring 17. The knot-free end 19 of the drawstring 17 is threaded through the hollow front end 14 and through the hollow mid-portion 18 to the rear end 16. The knot 15 is made sufficiently large so that it will not pass through the front end 14 to the mid-portion 18. The mid-portion 18 is grasped in a user's hand, and the front end 14 is inserted into one aperture 21 for the drawstring-reception channel of a bag 23. The front end 14 and the mid-portion portion 18 of the drawstring restringing apparatus 10 are pushed through the drawstring-reception channel of the bag 23 until the front end 14 emerges from the second aperture 25 for the drawstring-reception channel. When this procedure is followed, the walls of the drawstring-reception channel are bunched and straightened so they fit over the mid-portion 18 of the drawstring restringing apparatus 10. When the front end 14 emerges from the second aperture 25, the knot 15 is untied. Then, the drawstring 17 is grasped, behind the front end 14 of the drawstring restringing apparatus 10, and the drawstring restringing apparatus 10 is pulled out from the drawstring-reception channel of the bag 23. When this is done, the drawstring 17 is left restrung in the drawstring-reception channel of the bag 23.

Turning to FIGS. 6 and 7, a second embodiment of the invention is shown. Reference numerals are shown that correspond to like reference numerals that designate like elements shown in the other figures. In addition, the closed top 26 of the front end 14 includes a slit 32. The slit 32 has a slit-gap width 34. The slit-gap width 34 is less than the mid-portion-gap width 30.

In using the second embodiment of the invention, the knot 15 is tied in the drawstring 17, and the knot-free end 19 of the drawstring 17 is threaded through the front end 14 and the mid-portion 18 as described above for the first embodiment. Similarly, the drawstring restringing apparatus 10 is passed through the drawstring-reception channel of the bag 23 in the same way as for the first embodiment of the invention. However, once the front end 14 emerges from the second aperture 25. A portion of the drawstring 17 adjacent to the slit 32 can be pulled through the slit 32. Once this is done, the drawstring 17 can be grasped, and the drawstring restringing apparatus 10 can be pulled out from the drawstring-reception channel. From this description of the operation of the second embodiment of the invention, it is clear that the knot 15 does not have to be untied to remove the drawstring restringing apparatus 10 from the drawstring-reception channel to leave the drawstring 17 restrung in the drawstring-reception channel.

The components of the drawstring restringing apparatus of the invention can be made from inexpensive and durable plastic or metal materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved drawstring restringing apparatus that is low in cost, relatively simple in design and operation, and which may advantageously be used to without employing a C-shaped transverse portion for receiving a drawstring. With the invention, a drawstring restringing apparatus is provided which does not employ a cap that is placed on the end of the drawstring restringing device. With the invention, a drawstring restringing apparatus is provided which does not employ a helical drawstring-receiving end. With the invention, a drawstring restringing apparatus is provided which does not include a blunt edge which is pushed through a drawstring-reception channel. With the invention, a drawstring restringing apparatus is provided which has a portion which pushes against a portion of the drawstring as the drawstring is restrung through a drawstring-reception channel.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A drawstring restringing apparatus comprising:

a hollow main body having a longitudinal length, a hollow interior, a front end, a rear end, and a mid-portion located between the front end and the rear end, wherein a drawstring can be extended through the hollow interior of the main body so as to extend along all of the longitudinal length of the hollow main body;

wherein a leading portion of the front end is tapered from a top portion of the front end to a bottom portion of the front end;

wherein a portion of the front end located behind the leading portion includes a closed top;

wherein the mid-portion and the rear end include an open top which extends from the mid-portion through the rear end, the open top defining a mid-portion gap which has a mid-portion-gap width;

wherein a drawstring having a knot can be extended through the hollow interior of the main body such that the knot is abutted against the front end of the main body, and subsequently the front end and the mid-portion of the drawstring restringing apparatus can be pushed through a first aperture of a drawstring-reception channel until the front end emerges from a second aperture of the drawstring-reception channel, and subsequently the drawstring restringing apparatus can be separated from the drawstring and the drawstring-reception channel to leave the drawstring restrung in the drawstring-reception channel.

2. The apparatus of claim 1, wherein the closed top of the front end includes a slit with slit-gap width with less than the mid-portion gap extending therethrough into communication with a hollow interior of the hollow main body.

3. A method of restringing a drawstring through a drawstring-reception channel, the method comprising the steps of:

providing a drawstring restringing apparatus comprising a hollow main body having a longitudinal length, a hollow interior, a front end, a rear end, and a mid-portion located between the front end and the rear end, wherein a portion of the front end located behind the leading portion includes a closed top, wherein the mid-portion and the rear end include an open top which extends from the mid-portion through the rear end, the open top defining a mid-portion gap which has a mid-portion-gap width;

providing a drawstring having a knot;

extending the drawstring through the hollow interior of the main body such that the knot is abutted against the front end of the main body and the drawstring extends along all of the longitudinal length of the hollow main body;

pushing the front end and the mid-portion of the drawstring restringing apparatus through a first aperture of a drawstring-reception channel until the front end emerges from a second aperture of the drawstring-reception channel;

separating the drawstring restringing apparatus from the drawstring and the drawstring-reception channel to leave the drawstring restrung in the drawstring-reception channel.

4. A method of restringing a drawstring through a drawstring-reception channel, the method comprising the steps of:

providing a drawstring restringing apparatus comprising a hollow main body having a longitudinal length, a hollow interior, a front end, a rear end, and a mid-portion located between the front end and the rear end, wherein a portion of the front end located behind the leading portion includes a closed top, the closed top of the front end including a slit extending therethrough into communication with a hollow interior of the hollow main body, wherein the mid-portion and the rear end include an open top which extends from the mid-portion through the rear end, the open top defining a mid-portion gap which has a mid-portion-gap width, wherein the slit has a slit-gap width, with the slit-gap width being less than the mid-portion gap width;

providing a drawstring having a knot;

extending the drawstring through the hollow interior of the main body such that the knot is abutted against the front end of the main body and the drawstring extends along all of the longitudinal length of the hollow main body;

pushing the front end and the mid-portion of the drawstring restringing apparatus through a first aperture of a drawstring-reception channel until the front end emerges from a second aperture of the drawstring-reception channel;

separating the drawstring restringing apparatus from the drawstring by pulling a portion of the drawstring adjacent to the slit through the slit;

separating the drawstring restringing apparatus from the drawstring-reception channel to leave the drawstring restrung in the drawstring-reception channel.

* * * * *